US008998299B2

(12) United States Patent
Shmargad

(10) Patent No.: US 8,998,299 B2
(45) Date of Patent: Apr. 7, 2015

(54) ARMORED VEHICLE WITH BOLT-ON BOTTOM

(75) Inventor: Amikam Shmargad, Foster City, CA (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 213 days.

(21) Appl. No.: 13/608,827

(22) Filed: Sep. 10, 2012

(65) Prior Publication Data

US 2014/0208931 A1 Jul. 31, 2014

Related U.S. Application Data

(60) Provisional application No. 61/532,963, filed on Sep. 9, 2011.

(51) Int. Cl.

| | |
|---|---|
| ***F41H 7/02*** | (2006.01) |
| ***F41H 7/03*** | (2006.01) |
| ***F41H 7/04*** | (2006.01) |
| ***F41H 5/013*** | (2006.01) |

(52) U.S. Cl.

CPC ..... *F41H 7/042* (2013.01); *F41H 7/044* (2013.01); *F41H 5/013* (2013.01)

(58) Field of Classification Search

USPC ..... 296/187.08, 187.09, 193.07, 204, 296/187.07; 89/36.01, 36.08, 36.09

See application file for complete search history.

(56) References Cited

U.S. PATENT DOCUMENTS

| | | | | |
|---|---|---|---|---|
| 5,533,781 | A * | 7/1996 | Williams | 296/204 |
| 5,600,085 | A * | 2/1997 | Schalke et al. | 89/36.08 |
| 5,663,520 | A * | 9/1997 | Ladika et al. | 296/187.07 |
| 5,822,836 | A * | 10/1998 | Riddle | 29/401.1 |
| 6,477,934 | B1 * | 11/2002 | Bruhn et al. | 296/193.07 |
| 7,712,823 | B2 * | 5/2010 | Greuter et al. | 296/187.07 |
| 7,997,182 | B1 * | 8/2011 | Cox | 89/36.09 |
| 8,205,933 | B2 * | 6/2012 | Boczek et al. | 296/181.1 |
| 8,240,748 | B2 * | 8/2012 | Chapman | 296/193.04 |
| 8,413,567 | B2 * | 4/2013 | Luther et al. | 89/36.08 |
| 8,499,677 | B2 * | 8/2013 | Lee | 89/36.08 |
| 8,616,617 | B2 * | 12/2013 | Sherbeck et al. | 296/187.07 |
| 8,640,592 | B1 * | 2/2014 | Gabrys et al. | 89/36.04 |
| 8,707,848 | B2 * | 4/2014 | Allor et al. | 89/36.08 |
| 8,714,632 | B2 * | 5/2014 | Chapman | 296/193.04 |
| 2003/0010189 | A1 * | 1/2003 | Zonak | 89/36.08 |
| 2007/0084337 | A1 * | 4/2007 | Strassgurtl et al. | 89/36.08 |

(Continued)

FOREIGN PATENT DOCUMENTS

| | | |
|---|---|---|
| EP | 1182421 A1 | 2/2002 |
| EP | 0963903 B1 | 7/2006 |
| EP | 2207004 A2 | 7/2010 |
| EP | 2275773 A2 | 1/2011 |

OTHER PUBLICATIONS

International Search Report and Written Opinion for PCT/US2012/054449, filed Sep. 10, 2012, mailed on Jan. 29, 2013 (10 pgs.).

(Continued)

*Primary Examiner* — Gregory Blankenship

(74) *Attorney, Agent, or Firm* — Patterson Thuente Pedersen, P.A.

(57) ABSTRACT

A bottom plate assembly for securing a bottom plate to an armored vehicle for adding to the existing armor or replacing the existing armor on the underside of the vehicle. The bottom plate assembly secures bottom plate to the vehicle hull by securing the bottom plate to the sidewalls of the vehicle.

16 Claims, 5 Drawing Sheets

(56) References Cited

U.S. PATENT DOCUMENTS

| | | | | |
|---|---|---|---|---|
| 2010/0319525 | A1 | 12/2010 | Pavon | |
| 2011/0017054 | A1* | 1/2011 | Naroditsky et al. | 89/36.02 |
| 2012/0103177 | A1* | 5/2012 | Coltrane | 89/36.02 |
| 2012/0161472 | A1* | 6/2012 | Rawlinson et al. | 296/187.08 |
| 2012/0174767 | A1* | 7/2012 | Naroditsky et al. | 89/36.08 |
| 2012/0210861 | A1* | 8/2012 | Tobie | 89/36.04 |
| 2013/0249244 | A1* | 9/2013 | Cassaday et al. | 296/187.08 |
| 2013/0312595 | A1* | 11/2013 | Lee | 89/36.02 |
| 2014/0109757 | A1* | 4/2014 | Akavuti et al. | 89/36.02 |
| 2014/0130658 | A1* | 5/2014 | Gonzalez | 89/36.08 |

OTHER PUBLICATIONS

International Preliminary Report on Patentability from related PCT Application PCT/US2012/054449, dated Mar. 20, 2014, 9 pgs.

* cited by examiner

ARMORED VEHICLE WITH BOLT-ON BOTTOM

RELATED APPLICATION

The present application claims the benefit of U.S. Provisional Application No. 61/532,963, filed Sep. 9, 2011, which is incorporated herein by reference in its entirety.

FIELD OF THE INVENTION

The present invention is generally directed to a bottom plate assembly for an armored vehicle. Specifically, the present invention is generally directed to a bottom plate assembly and related method for affixing an armored bottom plate to retrofit an existing armored vehicle or attaching a bottom plate during the construction of a new armored vehicle.

BACKGROUND OF THE INVENTION

An armored vehicle typically comprises armor plates mounted on the sides, roof and the bottom of the vehicle. The substantial weight of the armor paneling creates a tradeoff between the operational weight of the vehicle that can be effectively handled by the vehicle engine versus the amount of armor necessary to protect the occupants and critical systems of the vehicle from likely threats. Accordingly, the vehicle armor is typically concentrated at the sides of the vehicle where the majority of the hostile fire will likely strike the vehicle, while the top and the bottom of the vehicle are relatively lightly armored to reduce the overall operational weight of the vehicle. In addition, the side armor plates used for armored vehicles have improved to the extent that penetrating the side armor of a vehicle with conventional weaponry has become very difficult. Advanced weaponry, such as High Explosive Anti-Tank ("HEAT") warheads fired by large bore cannons, is often required to eliminate to destroy or disable an armored vehicle through the side armor.

Accordingly, many anti-armored vehicle weapon systems used by combatants without access to advanced weaponry seek to exploit the vulnerable underbelly or top of the vehicle rather than seeking to overcome the thicker armor at the sides of the vehicle. In particular, mines and improvised explosive devices (IEDs) seek to exploit the thinner bottom armor plates of most armored vehicles by detonating beneath the vehicle to direct shrapnel and a concussive blast through the thinner bottom armor into the crew compartment. As a result, many new designed armored vehicles incorporate additional armor plating or specialized armor plating designed specifically for combating mine or IED attacks on the underside of the vehicle and other features to improve the protection of the underside of the vehicle. However, many older armored vehicles, such as the M2 Bradley Infantry Fighting Vehicles, are still susceptible to mines and IEDs.

An approach to improving the protection to the crew compartment and the critical systems of older vehicles is to add additional armor plating to the existing armor on the underside of the vehicle. The additional armor reduces the likelihood that the crew will be injured and/or critical systems damages, but substantially increases the weight of the underside armor. In addition to the challenge of determining how to mount additional armor over the existing armor, the additional weight extra armor can place considerable strain on the frame and sidewalls of older vehicles, which are designed for thinner, lighter armor panels. The strain can weaken the frame and increase the likelihood that the frame will fail during a mine or IED attack.

Similarly, an alternative approach is to remove the existing armor and to attach improved armor specifically directed to combating mines or IED attacks. However, as the vehicle is already assembled, removing the existing armor and affixing the new improved armor can be hindered by the existing vehicle assembly. The attachment points at which the existing armor is attached to the vehicle must be accessed and disengaged to remove the armor. Accessing the attachment points between the bottom armor and the vehicle through the structure of the assembled vehicle can be very difficult. Similarly, accessing the same attachment points to affix the replacement panel can be equally challenging. As a result, the replacement of existing armor with different armor plating can require considerable maintenance and downtime. The considerable time necessary to configure a vehicle to counter a specific threat presents substantial logistical challenges and can limit the abilities of the vehicle.

The increased use of IEDs and mines in certain conflicts has created a need for improved protection of the underside of crew compartments for armored vehicles. In addition to the need for improved protection, there is need for quickly and efficiently to returning the vehicles to operation or configuring vehicles to counter specific threats such as IEDs and mines,

SUMMARY OF THE INVENTION

An embodiment of the present invention is directed to mounting at least one armored bottom to a new armored vehicle or the retrofit of an existing armored vehicle to retrofit the vehicle with new or additional underside armor. The bottom plate can be removed and exchanged with a new bottom plate tailored for specific threats without the need to remanufacture the entire vehicle. In one aspect, the bottom plate can comprise a plurality of flanges extending from the periphery of the bottom plate. The flanges can be bolted to the sidewalls of the armored vehicle to secure the bottom plate to the vehicle. In this configuration, the bottom plate can be fitted over the existing armor panels to supplement the armor panels or positioned into the space vacated by the removed original panels to replace the original panels from underneath the vehicle. Accordingly, the bottom plate can be maneuvered into position without removing other vehicle components to clear space to position the bottom plate against the underside of the vehicle.

In another aspect, the bottom plate assembly can further comprise side plates mounted to the sidewalls of the vehicle, wherein each side plate presents an engagement surface at the bottom edge of the side plate to which the bottom plate can be secured to affix the bottom plate to the vehicle. The side plates can comprise at least one axle hole for receiving the axles of the wheels or drive wheels and roller wheels of the vehicle. In this configuration, the side plates can reinforce the sidewalls of the vehicle such that a bottom plate having heavier armor can be affixed to the vehicle without overstraining the frame. The side plates can also operate to distribute weight of the armor panels over a plurality of engagement points distributed over a larger area of the sidewalls to further reduce the strain created by the heavier armor panels.

A bottom plate assembly, according to an embodiment of the present invention, can comprise a bottom plate having a plurality of flanges extending from the periphery of the bottom plate. The bottom plate can be sized to cover the entire bottom of the vehicle front and aft. Each flange extends outward from the bottom plate at an angle generally perpendicular to the plane defined by the bottom plate such that the flange is parallel to the corresponding portion of the vehicle. Each flange defines at least one bore hole for receiving a fastener to secure the flange, and the attached bottom plate, to the vehicle. In one aspect, the flanges can be positioned on the sides of the bottom plate for engagement to the sidewalls of the vehicle. An adhesive can be applied to each flange in addition to or instead of the fasteners to secure the bottom plate to the vehicle. In one aspect, the flanges can also be positioned along the front and back edges of the bottom plate for engagement to the front and back walls of the vehicle.

In one aspect, the flanges can be spaced along the periphery of the bottom plate to define gaps between the flanges through which axles for the wheels or rollers for the drive assembly of the vehicle can extend without engaging the flanges. Similarly, the number and size of the flanges can be selected according to the weight, shape or design of the bottom plate. Heavier, more heavily armored plates can comprise additional and/or larger flanges effectively support the plate to the vehicle while lighter plates comprising less armor or lighter material can comprise fewer and/or smaller flanges to further reduce the operational weight of the vehicle. In another aspect, the flanges can be sized to position the bottom plate over the existing armor plates.

A bottom plate assembly, according to another embodiment of the present invention, can comprise at least two side plates and a bottom plate. Each side plate can further comprise a bottom edge and at least one axle bore corresponding to the axles for the drive wheels or roller wheels for treaded armored vehicles or the wheels for wheeled armored vehicles. The side plates can be positioned in parallel on either side of the vehicle proximate to the sidewalls of the vehicle and secured to the corresponding sidewalls with fasteners and/or adhesive. The bottom plate can then be bolted to the bottom edge of the side plates to secure the bottom plate to the vehicle. In one aspect, the bottom edge can define a flanged end to present a larger mounting surface to which the bottom plate can be secured.

In one aspect, the side plates can be sized to reinforce the sidewalls of the vehicle to support the additional weight from a more heavily armored bottom panel. Similarly, the bottom plate assembly can also further comprise at least one reinforcement beam extending the length of the bottom plate to support the bottom plate when mounted to the vehicle.

In one aspect, a sealant can be applied to the interface between the bottom plate and the side plate to prevent contaminants or NBC threats from penetrating the crew compartment through gaps between the bottom plate and the side plate. The sealant can also be applied to the interfaces between the bottom plate and portions of the vehicle.

A method of affixing a bottom plate to the underside of a vehicle, according to an embodiment of the present invention, comprises providing a bottom plate having a plurality of flanges extending from the periphery of the bottom plate, wherein each flange is angled relative to the plane defined by the bottom plate to correspond to the contour of at least one exterior wall of the vehicle. The method can further comprise inserting at least one fastener through each flange to secure the bottom plate to the corresponding exterior wall of the vehicle. In one aspect, the method can further comprise applying an adhesive to each flange to secure the flange to the corresponding exterior wall. The method can also comprise applying a sealant to the interfaces between the vehicle and the bottom plate to prevent contaminants from penetrating the vehicle through gaps between the vehicle and the bottom plate.

A method of affixing a bottom plate to the underside of a vehicle, according to an embodiment of the present invention, comprises providing at least two side plates and a bottom plate. The method further comprises inserting at least one fastener through each side plates to affix the side plates to the corresponding sidewalls of the vehicle. In one aspect, the method can further comprise applying an adhesive to each side plate to secure the side plate to the corresponding sidewall. The bottom plate can then be affixed to the bottom edge of each side plate to attach the bottom plate to the vehicle.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE CLAIMS

The invention can be completely understood in consideration of the following detailed description of various embodiments of the invention in connection with the accompanying drawings, in which.

Figure 1:
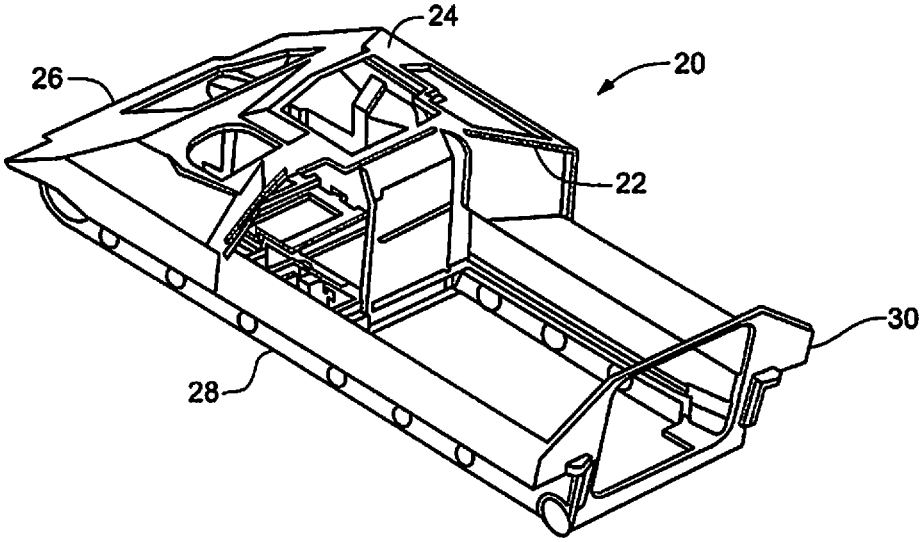
FIG. 1 is a top perspective view of a crew compartment for a vehicle for use with the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 2:
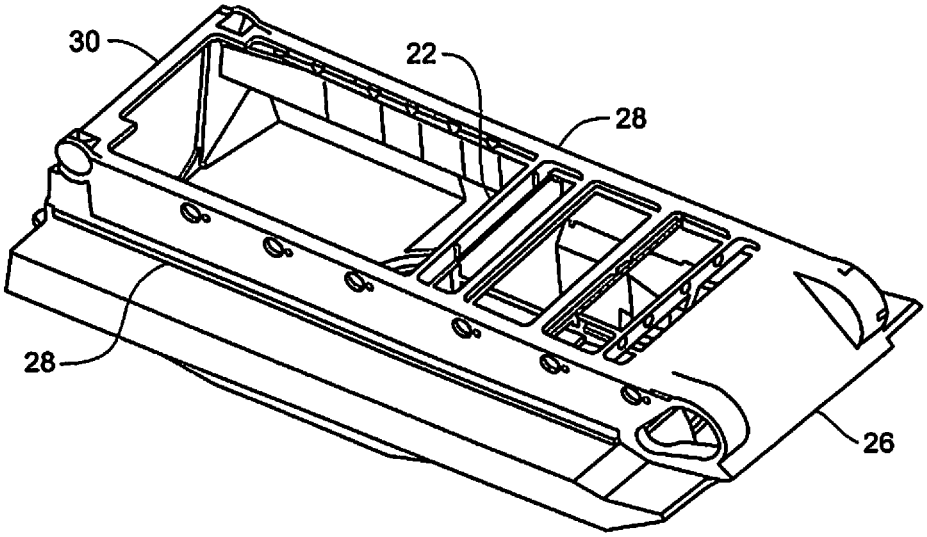
FIG. 2 is a bottom perspective view of the crew compartment depicted in FIG. 1.

As depicted in FIG. 1-2, a vehicle 20 for use with the present invention can generally comprise a vehicle frame 22 and a vehicle hull 24. The vehicle hull 24 further comprises a front wall 26, sidewalls 28 and a rear wall 30. The vehicle 20 can further comprise a plurality of drive wheels and roller wheels for operating a tracked drive system. Similarly, the vehicle 20 can further comprise a plurality of wheels for wheeled drive system. As depicted in FIG. 1, the underside of the vehicle hull 24 can be open exposing the vehicle frame 22.

In one aspect, an armored plate can be positioned on the underside of the vehicle hull 24. As depicted, the vehicle 20 is a Bradley Infantry Fighting Vehicle (IFV), but can comprise any wheeled or tracked armored vehicle.

Figure 3:
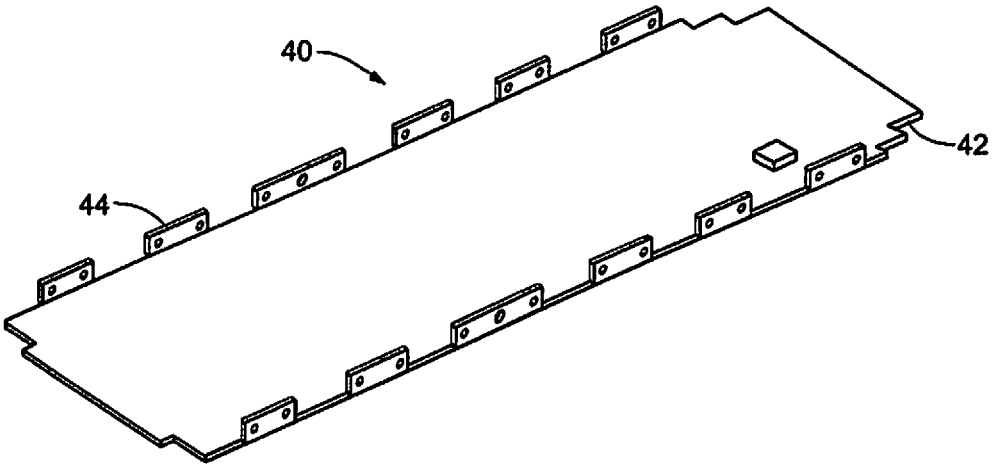
FIG. 3 is a top perspective view of a bottom plate assembly according to an embodiment of the present invention.
Figure 4:
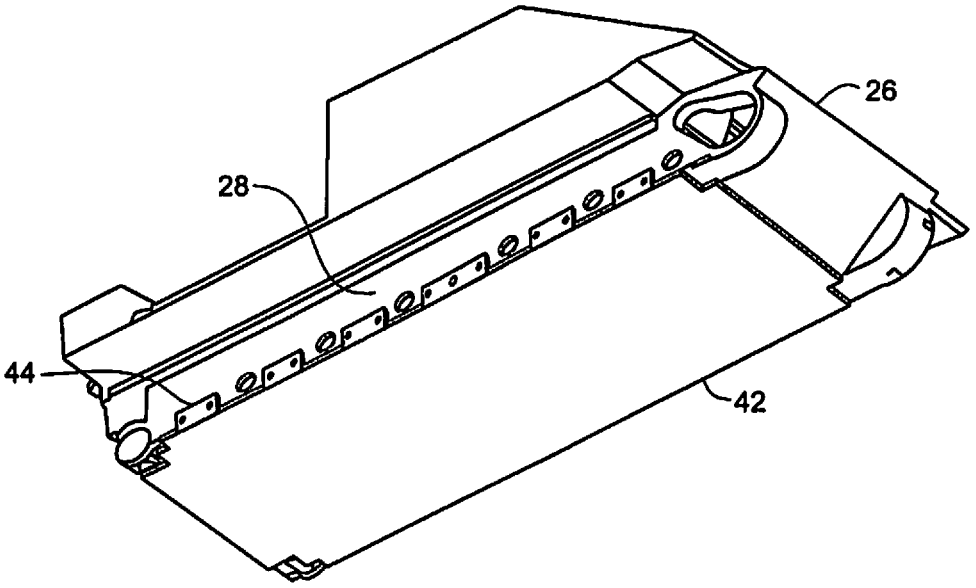
FIG. 4 is a bottom perspective view of the bottom plate assembly depicted in FIG. 3 affixed to a vehicle, according to an embodiment of the present invention.
Figure 5:
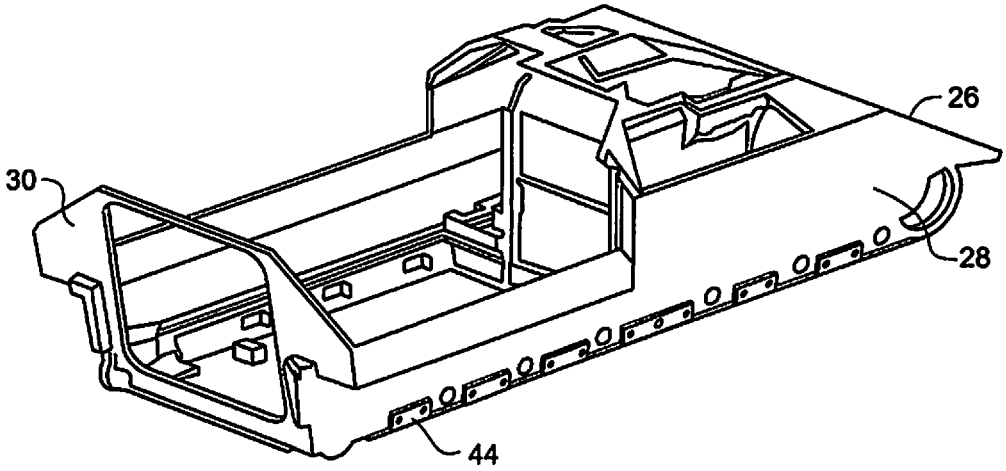
FIG. 5 is a top perspective view of the bottom plate assembly—vehicle assembly depicted in FIG. 4.
Figure 6:
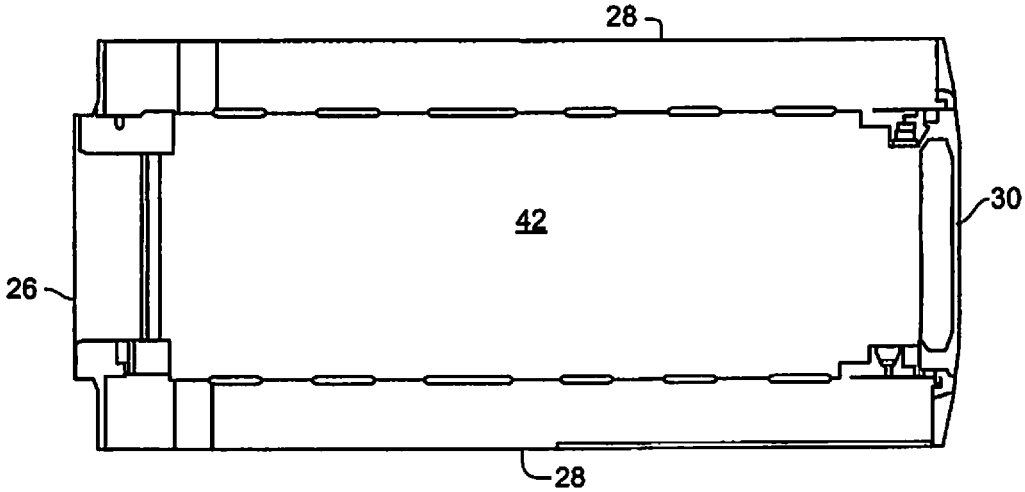
FIG. 6 is a bottom view of the bottom plate assembly—vehicle assembly depicted in FIG. 4.
Figure 7:
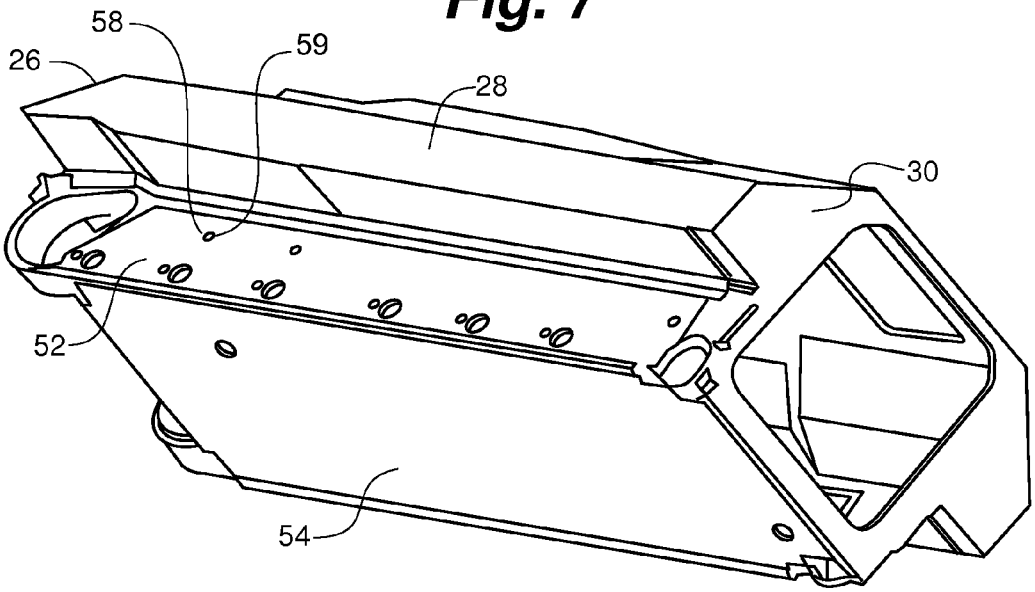
FIG. 7 is an exploded top perspective view of a bottom plate assembly, according to an embodiment of the present invention, positioned for engagement to a vehicle.

As depicted in FIGS. 3-6, a bottom plate assembly 40, according to an embodiment of the present invention, comprises a bottom plate 42 defining a plane and having a plurality of flanges 44 arranged around the periphery of the bottom plate 42. Each of the flanges 44 extend outwardly from the periphery of the bottom plate 42 at an angle corresponding to the shape of the corresponding wall of the vehicle hull 24. In one aspect, the plurality of the flanges 44 can be positioned on the sides of the bottom plate 42 such that the flanges 44 are positioned to correspond to the sidewalls 28 of the vehicle hull 24. Each flange 44 can further comprise at least one bore hole 46 for receiving a fastener 48 to secure the flange 44 and the bottom plate 42 to a corresponding side wall 26, 28, 30 of the vehicle 20. In one aspect, an adhesive can be applied to each flange 44 to secure the flange 44 to the sidewall 28 or to supplement the fasteners 48 in retaining the bottom plate 42 to the vehicle 20. As depicted in FIGS. 3-5, the flanges 44 can be spaced apart along the sides of the bottom plate 42 to correspond to the sidewalls 28 of vehicle hull 24. In one aspect, the flanges 44 can be spaced along the front side and back side of the bottom plate 42 such that the flanges 44 can be affixed to the corresponding front wall 26 or rear wall 30 of the vehicle hull 24.

In one aspect, the number and size of the flanges 44 can be varied depending on the weight and type of armor incorporated into the bottom plate 42. Lower weight, lightly armored bottom plates 42 require fewer and/or smaller flanges 44 to support the bottom plate 42 to the vehicle 44. Similarly, heavier, more heavily armored bottom plates 32 require more and/or larger flanges 44 to efficiently affix the bottom plate 42. As depicted in FIG. 5, in one aspect, the flanges 44 can be spaced around the periphery of the bottom plate 42 such that the axles of the drive system pass between the flanges 44.

In operation, the bottom plate 42 is aligned with the underside of the vehicle 20 and elevated until the bottom plate 42 engages the bottom of the vehicle hull 24, which aligns the flanges 44 with the corresponding portions of the sidewalls 28 of the vehicle hull 24. In one aspect, a sealant can be applied to the portions of the bottom plate 42 that interface with the vehicle hull 24 to seal the interface between the bottom plate 42 and the vehicle hull 24 to prevent passage of containments between the bottom plate 42 and the vehicle hull 24. The fasteners 48 are then inserted to secure the bottom plate 42 to the vehicle hull 24. In one aspect, the bottom plate 42 can be positioned over the original armored plating on the underside of the vehicle hull 24. In this configuration, the flanges 44 can be sized to reach the additional distance required to reach the appropriate portions of the sidewalls 28 to secure the bottom plate 42 over the original armored plating.

A method of affixing a bottom plate 42 to the underside of a vehicle 20, according to an embodiment of the present invention, comprises providing a bottom plate 42 having a plurality of flanges 44 extending from the periphery of the bottom plate 42, wherein each flange 44 is angled relative to the plane defined by the bottom plate 42 to correspond to the contours of at least one exterior wall of the vehicle. The method can further comprise inserting at least one fastener 48 through each flange 44 to secure the bottom plate 42 to the corresponding exterior wall 26, 28, 30 of the vehicle. In one aspect, the method can further comprise applying an adhesive to each flange 44 to secure the flange 44 to the corresponding exterior wall 26, 28, 30. The method can also comprise applying a sealant at the interface between the vehicle 20 and the bottom plate 42 to prevent contaminants from penetrating the crew compartment through gaps between the vehicle 20 and the bottom plate 42.

As depicted in FIGS. 7-10, a bottom plate assembly 50, according to an embodiment of the present invention, comprises at least two side plates 52 and a bottom plate 54. Each side plates 52 comprises a bottom edge 56 and defines a plurality of bore holes 58 for receiving a fastener 59 to secure the bottom assembly to the corresponding side wall 28. In one aspect, an adhesive is applied to the interface between the side plates 52 in addition to, or in place of, the fastener 59 to secure the side plates 52 to the side walls 28 of the vehicle hull 24. In one aspect, the bottom edge 56 can define a flanged end 60 presenting a larger surface for interfacing with the bottom plate 54. A fastener 59 can be inserted through the bottom plate 54 to secure the bottom plate 54 to the bottom edge 56 of each side plate 52. In one aspect, an adhesive can be applied to the bottom edge 56 of the side plates 52 to secure the bottom plate 54 to the vehicle 20.

Figure 8:
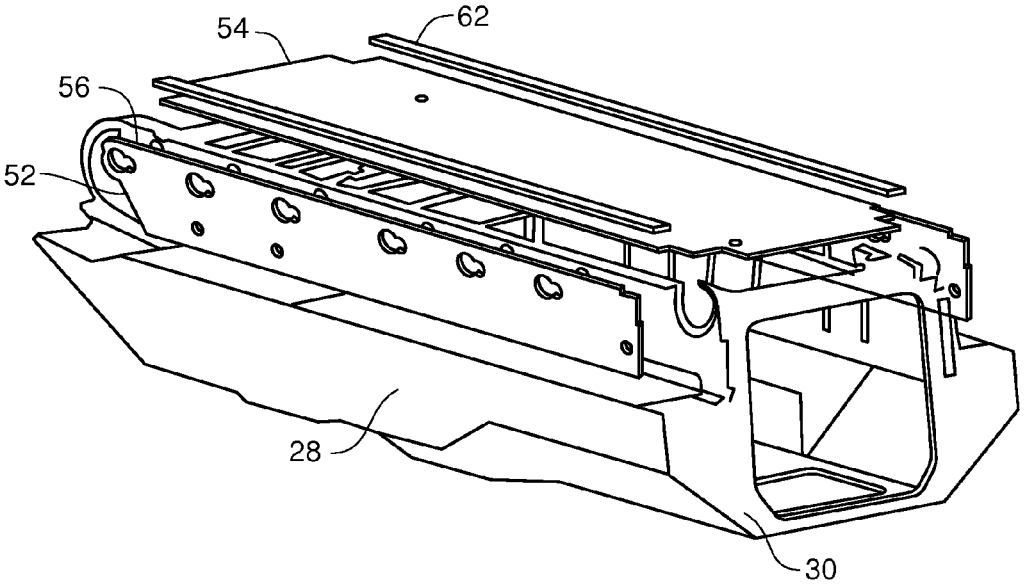
FIG. 8 is bottom perspective view of the bottom plate assembly depicted in FIG. 7 affixed to the vehicle.
Figure 9:
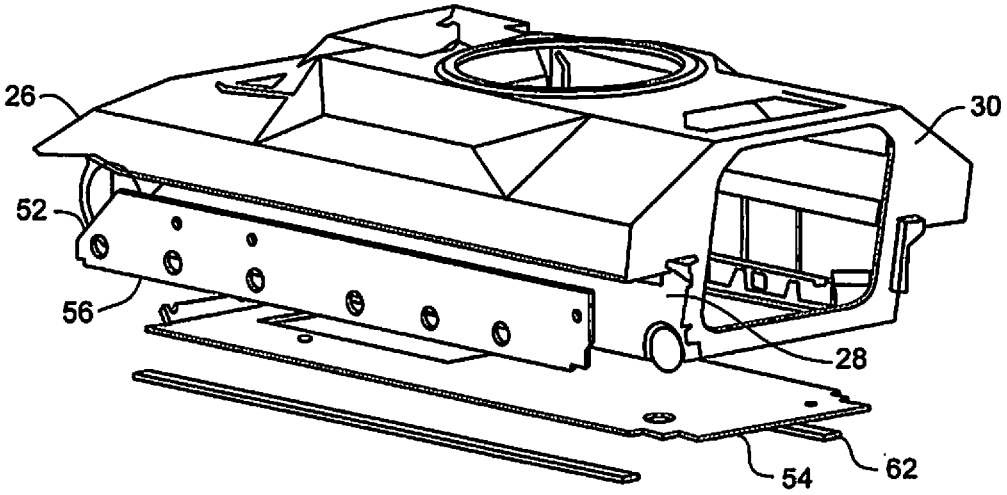
FIG. 9 is an exploded bottom perspective view of the bottom plate assembly depicted in FIG. 7.
Figure 10:
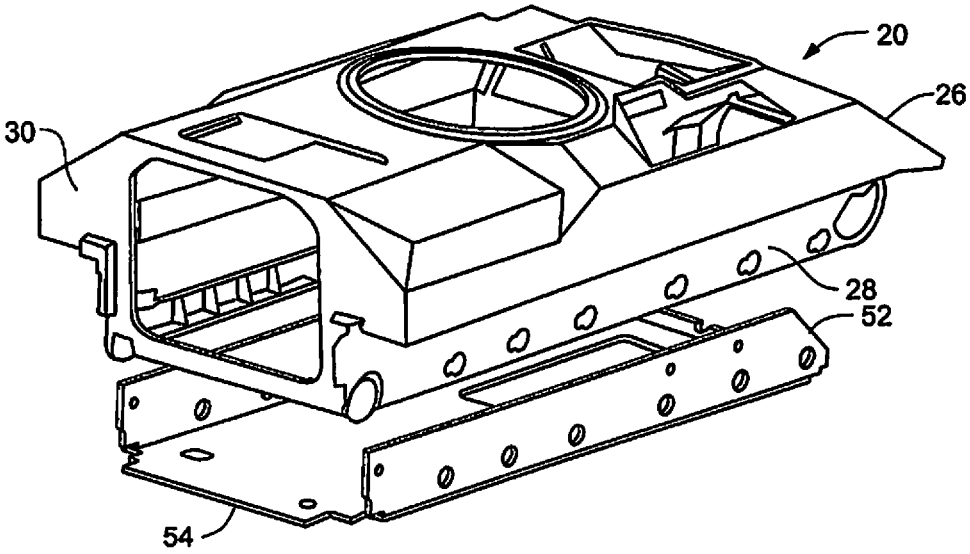
FIG. 10 is a partially exploded top view of a bottom plate assembly, according to an embodiment of the present invention, positioned for engagement to a vehicle.

As depicted in FIG. 8, in one aspect, the side plates 52 are sized to reinforce the sidewalls 28 of the vehicle hull 24 to allow the mounting of heavier, more armored bottom plates 54. In one aspect, the side plates 52 can be sized distribute the attachment points between the side plate 52 and the corresponding sidewall 28 over a large area distribute the weight of the bottom plate 54 over a larger area to reduce the likelihood that the vehicle frame 22 will become overstrained. Similarly, the bottom plate 54 can further comprise at least one elongated support beam 62 to reinforce the bottom plate 24. In operation, the side plates 52 are secured to the corresponding side walls 28 of the vehicle hull 24. The side plates 52 are oriented to follow the counters of the side walls 28 to present two generally parallel bottom edges 56. The bottom plate 54 can then be affixed to the bottom edges 56 of the side walls 28. In one aspect, a sealant can be applied to interface points between the bottom plate 54 and the vehicle hull 24 to prevent NBC contaminants from penetrating between the bottom plate 54 and the vehicle hull 24.

A method of affixing a bottom plate 54 to the underside of a vehicle 20, according to an embodiment of the present invention, comprises providing at least two side plates 52 and a bottom plate 54. The method further comprises inserting at least one fastener 58 through each side plates 52 to affix the side plates 52 to the corresponding sidewalls 28 of the vehicle 20. In one aspect, the method can further comprise applying an adhesive to each side plate 52 to secure the side plate 52 to the corresponding sidewall. The bottom plate 54 can then be affixed to the bottom edge of each side plate 52 to attach the bottom plate 54 to the vehicle 20.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A bottom plate assembly for an armored vehicle having a generally rectangular vehicle hull with a front wall, sidewalls and a rear wall, comprising:

a bottom plate having two parallel side edges and a plurality of flanges spaced along the side edges of the bottom plate, wherein the flanges are angled relative to the bottom plate to correspond to the contour of the sidewalls;

a sealant applied to the bottom plate preventing contaminants from passing between the bottom plate and the vehicle hull; and a plurality of fasteners each insertable through a corresponding flange of the plurality of flanges to secure the flange to the sidewall of the vehicle hull to secure the bottom plate to the vehicle hull.

2. The bottom plate assembly of claim 1, further comprising an adhesive applied to each of the plurality of flanges for affixing to the flanges to the corresponding sidewall.

3. The bottom plate assembly of claim 1, wherein the bottom plate further comprise a front edge and a rear edge and a plurality of secondary flanges spaced along the front and rear edge, wherein the secondary flanges are angled relative to the bottom plate to correspond to the contours of the front wall and the bottom wall.

4. A bottom plate assembly for an armored vehicle having a generally rectangular vehicle hull with a front wall, sidewalls and a rear wall, comprising:

at least two side plates having a bottom edge, wherein each side plate is adapted to receive at least one fastener for securing the side plate to a corresponding sidewall of the vehicle hull;

a bottom plate adapted to receive at least one fastener at the periphery of the bottom plate for securing the bottom plate to the bottom edge of at least one side plate, and at least one elongated support beam affixed to the bottom plate at the bottom edge of the side plate.

5. The bottom plate assembly of claim 4, further comprising a sealant applied to the bottom plate preventing contaminants from passing between the bottom plate and the vehicle hull.

6. The bottom plate assembly of claim 4, further comprising an adhesive applied to each side plate for affixing to the side plate to the corresponding sidewall.

7. The bottom plate assembly of claim 4, further comprising an adhesive applied to the bottom plate for affixing to the bottom plate to the bottom edges of the side plates.

8. The bottom plate assembly of claim 4, wherein the bottom edge of each side plate defines a flanged end.

9. A method of attaching a bottom plate to an armored vehicle having a generally rectangular vehicle hull with a front wall, sidewalls and a rear wall, comprising:

providing a bottom plate having two parallel side edges and a plurality of flanges spaced along the side edges of the bottom plate, wherein the flanges are angled relative to the bottom plate to correspond to the contour of the sidewalls;

positioning the bottom plate against the vehicle hull such that the flanges engage the corresponding sidewall; and affixing the flange to the corresponding sidewall to secure the bottom plate against the vehicle hull; and applying sealant to the bottom plate to prevent the passage of contaminants between the vehicle hull and the bottom plate.

10. The method of attaching a bottom plate of claim 9, further comprising:

applying adhesive to each flange for affixing the flange to the corresponding sidewall.

11. The method of attaching a bottom plate of claim 9, further comprising:

inserting at least one fastener through each flange to secure the flange to the corresponding sidewall.

12. The method of attaching a bottom plate of claim 9, further comprising:

positioning the flanges to permit passage of drive axles for a drive assembly for the vehicle between the flanges.

13. A method of attaching a bottom plate to an armored vehicle having a generally rectangular vehicle hull with a front wall, sidewalls and a rear wall, comprising:

providing at least two side plates, each having a bottom edge;

providing a bottom plate;

affixing each side plate to one of the side walls such that the bottom edges of the side plates are positioned in parallel;

positioning the bottom plate against the vehicle hull, wherein bottom edges of the side plates are positioned to engage a portion of the bottom plate when the bottom plate is positioned against the vehicle hull; and affixing the bottom plate to the bottom edges of the side plates to secure the bottom plate against the vehicle hull; and applying sealant to the bottom plate to prevent the passage of contaminants between the vehicle hull and the bottom plate.

14. The method of attaching a bottom plate of claim 13, further comprising:

applying adhesive to each side plate for affixing the side plate to the corresponding sidewall.

15. The method of attaching a bottom plate of claim 13, further comprising:

inserting at least one fastener through each side plate to secure the sideplate to the corresponding sidewall.

16. The method of attaching a bottom plate of claim 13, further comprising:

applying adhesive to the bottom edge of each side plate for affixing the side plate to the bottom plate.

* * * * *

UNITED STATES PATENT AND TRADEMARK OFFICE

CERTIFICATE OF CORRECTION

PATENT NO. : 8,998,299 B2
APPLICATION NO. : 13/608827
DATED : April 7, 2015
INVENTOR(S) : Amikam Shmargad It is certified that error appears in the above-identified patent and that said Letters Patent is hereby corrected as shown below:

Specification

Column 6, Line 30
Insert a paragraph break before the word "In".

Signed and Sealed this
Tenth Day of November, 2015

Michelle K. Lee

Michelle K. Lee
*Director of the United States Patent and Trademark Office*